252-99 AU 166 EX
1/8/80 OR 4,182,683

United States Patent [19]

Irvine et al.

[11] 4,182,683

[45] Jan. 8, 1980

[54] PROCESS FOR THE MANUFACTURE OF A DISHWASHING DETERGENT

[76] Inventors: John K. Irvine; Michael D. Mitchell; Gunter H. Berk, all of Conn Chem Limited, 13 Bethridge Rd., Rexdale, Ontario, Canada

[21] Appl. No.: 897,199

[22] Filed: Apr. 17, 1978

Related U.S. Application Data

[63] Continuation-in-part of Ser. No. 687,037, May 17, 1976, abandoned.

[51] Int. Cl.[2] ..... C11D 11/00; C11D 7/56

[52] U.S. Cl. ..... 252/99; 23/313 R; 23/313 P; 252/135

[58] Field of Search ..... 252/99, 135; 23/313 R, 23/313 P

[56] References Cited

U.S. PATENT DOCUMENTS

| | | | |
|---|---|---|---|
| 3,248,330 | 4/1966 | Feierstein et al. | 252/99 |
| 3,306,858 | 2/1967 | Oberle | 252/99 |
| 3,361,675 | 1/1968 | Fuchs et al. | 252/99 |
| 3,598,743 | 8/1971 | Coates | 252/99 |
| 3,609,088 | 9/1971 | Sumner | 252/99 |
| 3,625,902 | 12/1971 | Sumner | 252/99 |
| 3,630,928 | 12/1971 | Fuchs | 252/135 |
| 3,741,904 | 6/1973 | Christensen et al. | 252/99 |
| 3,888,781 | 10/1975 | Kingry et al. | 252/99 |
| 4,077,897 | 3/1978 | Gault | 252/99 |

*Primary Examiner*—P. E. Willis, Jr.

[57] ABSTRACT

A process for the manufacture of a free flowing granular dishwasher detergent having enhanced chlorine stability over extended periods of shelf life is disclosed. The process comprises mixing in a ventilated vessel, a dry mixture of sodium tripolyphosphate and chlorinated trisodium phosphate. The ratio of the volume of the dry mixture and the volume of the vessel is between about 1:25 and 1:8. An aqueous solution of silicate is sprayed onto the dry mixture to form an agglomerate during hydration of the sodium tripolyphosphate. The formed agglomerate is sprayed with a nonionic surfactant. The treated agglomerate is coated with a silicate. The coated agglomerate is mixed in the vessel while being discharged from the vessel. The silicate coated agglomerate inhibits chlorine loss from the dishwasher detergent over extended periods.

10 Claims, 2 Drawing Figures

PROCESS FOR THE MANUFACTURE OF A DISHWASHING DETERGENT

This is a continuation-in-part application of application Ser. No. 687,037, filed May 17, 1976 (now abandoned).

FIELD OF THE INVENTION

This invention relates to a process and composition for a dishwasher detergent having enhanced chlorine stability over extended periods of shelf life.

BACKGROUND OF THE INVENTION

A problem with most agglomerated dishwasher detergents is the product's chlorine retension over extended periods of shelf life such as six months to a year. The chlorine content in the detergent is important because of the very desireable bleaching and germicidal action it provides during the wash cycle. A number of existing processes for agglomerating dishwasher detergent and simultaneous hydration of sodium tripolyphosphate involve steps which are conducted at temperatures in excess of 150° F., such as, the temperature of sprayed solutions and of the bed of agglomerated material. Usually the source of chlorine is unstable at these temperatures and results in driving some chlorine from the initial mixture thereby reducing the chlorine content to an unacceptable level in the freshly prepared product. To avoid this aspect, it has been the practice to add the source of chlorine to the composition after the high temperature agglomeration step. It has been found, however, that with either of these methods, the chlorine stability of the product is far from desirable and with some dishwasher detergents the chlorine loss over a six month period can be as high as 40 to 60%.

The process of this invention maintains the bed temperature during the agglomeration of the detergent constituents at which the chlorine source is relatively stable to thereby retain the available chlorine in the formed agglomerate. The agglomerate is treated with a surfactant and coated with a silicate to lock in the available chlorine and inhibit it's loss from the dishwasher detergent over extended periods of shelf life.

SUMMARY OF THE INVENTION

The process according to this invention is capable of manufacturing a free flowing granular agglomerated dishwasher detergent having non-friable characteristics. The dishwasher detergent is made up of typical components which include hydrated forms of sodium tripolyphosphate, a silicate selected from the group consisting of sodium silicate, potassium silicate and mixtures thereof having a weight ratio of $SiO_2$ to $Na_2O$ or $K_2O$ between approximately 2.4:1 and approximately 3.25:1, chlorinated trisodiumphosphate as the source of chlorine, a non-ionic surfactant of low foam characteristics and their chemical equivalents.

The process comprises the steps of:

1. Mixing in a ventilated mixing vessel a dry mixture of 30 to 45% by weight of sodium tripolyphosphate, 20 to 30% by weight of chlorinated trisodium phosphate. The ratio of the volume of the dry mixture and the volume of the vessel is between approximately 1:25 and 1:8.

2. Approximately 15 to 30% by way of an aqueous solution of selected silicate at ambient temperature is sprayed onto the dry mixture while continuing the mixing. This forms an agglomerate of the dry mixture while hydration of the sodium tripolyphosphate is under way.

3. 1.5 to 6% by weight of a non-ionic surfactant at ambient temperature is sprayed onto the formed agglomerate.

4. The so treated agglomerate is coated by spraying onto it a further 10 to 25% by weight of an aqueous solution of selected silicate at ambient temperature to make up a total of 25 to 40% by weight of silicate used.

5. Mix the coated agglomerate in the vessel to ventilate it to the air of the vessel while discharging the coated agglomerate from the vessel.

In order to conduct the agglomeration of the components and simultaneous hydration of the sodium tripolyphosphate at a relatively low temperature, the ratio of the volumes and the ventilation of the mixing vessel maintains the mixture temperature in a range at which the chlorinated trisodium phosphate is relatively stable. This ensures that the available chlorine in the freshly charged chlorinated trisodium phosphate is retained in the formed agglomerate. The coating of the agglomerate with the silicate acts to lock in or encapsulate the agglomerate to inhibit chlorine loss from the detergent over extended periods of shelf life. The ventilation and volume ratio eliminates the need for separate drying stages. Once the coated product is formed, it is ready for discharge and storage.

Minor amounts of water may be used in this process wherein step 2, prior to the spraying of the selected silicate, approximately one percent by weight water is sprayed onto the dry mixture to commence hydration of the sodium tripolyphosphate. It is understood, however, that the water for hydrating the sodium tripolyphosphate is derived principally from the aqueous solution of the first spray of silicate.

The formed dishwasher composition is of a unique structure in that the agglomerated constituents of the dishwasher detergent are coated by an outer layer of silicate. Such coating not only inhibits chlorine loss from the product but also resists break up of the product during handling, packaging and dispensing to maintain a free flowing granular dishwasher detergent.

DESCRIPTION OF THE DRAWINGS

These and other advantages and features of the invention will become apparent to those skilled in the art in the following detailed description of preferred embodiments of the process as schematically shown in the drawings wherein.

DETAILED DESCRIPTION OF THE PREFERRED EMBODIMENTS OF THE INVENTION

Figure 1:
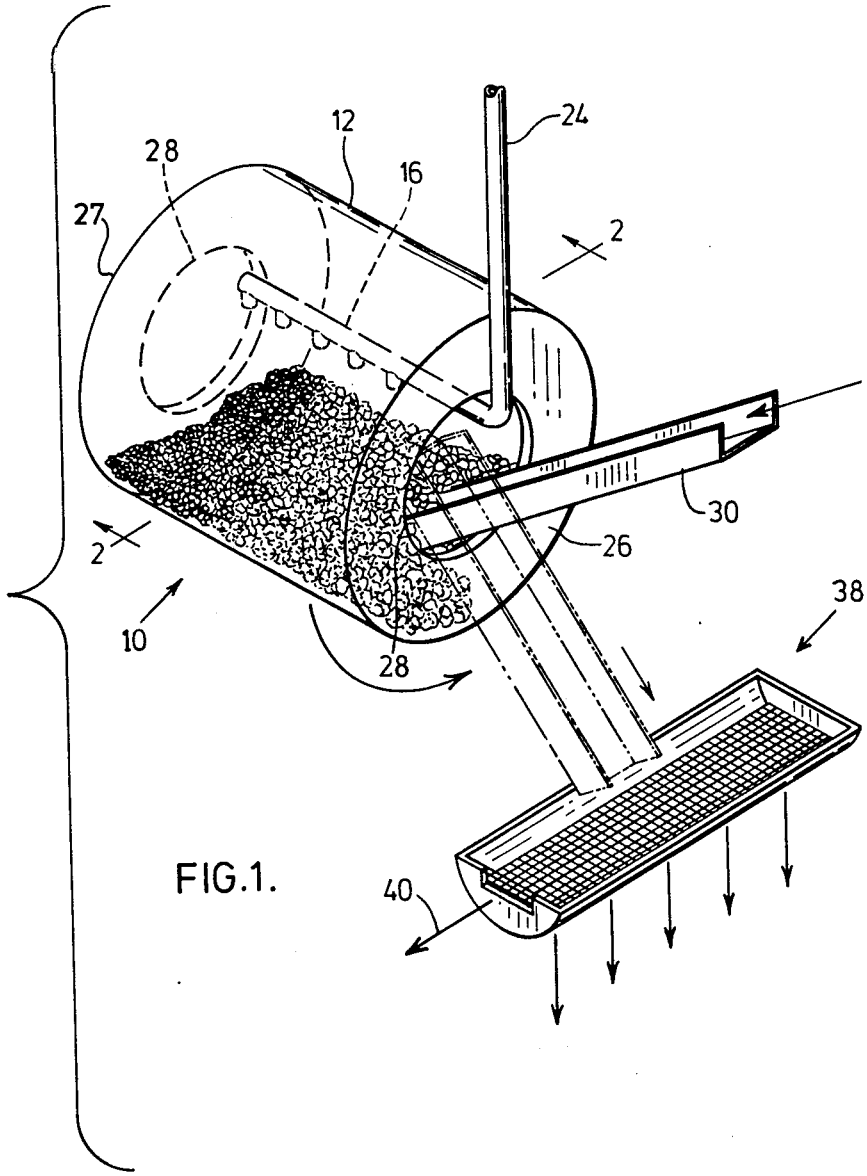
FIG. 1 schematically represents a mixing vessel in which the steps of the preferred process are carried out.
Figure 2:
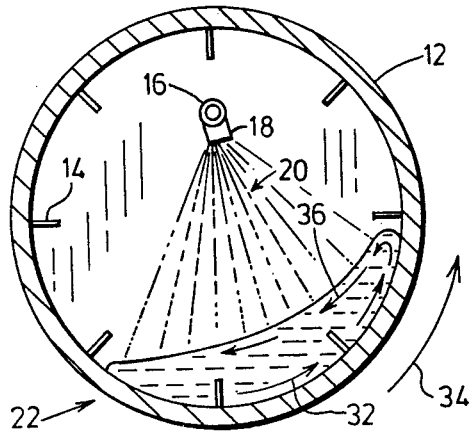
FIG. 2 is a representative section through the mixing vessel of FIG. 1 to demonstrate the spray pattern and moving bed of dry mixture in the mixing vessel.

It is appreciated that the process of this invention can be carried out in several various types of ventilated mixing vessels which can provide for the ratio of the volume of the dry mixture and the volume of the vessel between 1:25 and 1:8. According to a preferred aspect, the mixing vessel as schematically shown in FIG. 1 comprises a modified Struthers-Wells mixer 10 consisting of a horizontally disposed rotatable stainless steel drum 12 with a motor (not shown) to rotate the drum about it's longitudinally disposed horizontal axis. Flight bars 14 as shown in FIG. 2 are located on the inner wall of the drum 12 to provide for mixing of the ingredients during rotation of the drum in a well known manner. A stationary longitudinally extending liquid conduit 16 shown in dot in FIG. 1 has a plurality of spray nozzles 18 as shown in FIG. 2 which direct a spray pattern, generally designated 20 downwardly onto the moving bed generally designated 22 in the bottom of the mixing drum 12. The liquid conduit 16 is connected to a supply line 24 which supplies the liquid ingredients. At ends 26 and 27 of the drum are openings 28 which ventilate the drum and also provide entry for a chute 30 which in the position shown in FIG. 1 provides for the charging of dry ingredients into the system and as shown in dot in FIG. 1, is movable to a downwardly depending position to provide for discharge of the ingredients while the drum is rotated.

Although it is not fully understood what chemical or physical mechanism is responsible for the coating of the formed agglomerate with the silicate, it is theorized that the treating of the agglomerate by spraying on it's surface a non-ionic surfactant, reduces the surface tension of the particle. On subsequent spray of the silicate, it coats the particles with a fine film rather than forming larger agglomerates. It is also possible that at the point of spraying the non-ionic surfactant onto the surface of the formed agglomerate the surfactant is absorbed to provide an essentially dry surface which due to the surface tension reduction properties of the surfactant the silicate coats the product rather than forming larger aggregates.

The typical components used in dishwasher detergents are well known to those skilled in the art. The presence of the hydrated sodium tripolyphosphate is important as a sequestering agent and must be substantially hydrated in the detergent product to be useful in a dishwasher to avoid gumming, gelling or caking and clogging the dishwasher during the washing cycle. Since hydrated sodium tripolyphosphate is too costly to be practically used in the dishwasher detergent, it is necessary to use the anhydrous form of sodium tripolyphosphate and hydrate it during the agglomeration and coating process.

The source of chlorine is preferrably chlorinated trisodium phosphate and as previously explained is a necessary ingredient for releasing chlorine during the washing cycle to bleach and act as a germicide. The chlorinated trisodium phosphate is in a dry granular form which does not release its chlorine to any appreciable extent upon exposure to moisture as encountered during the aggomeration and coating steps.

The liquid silicates used should preferrably have a ratio of $SiO_2$ to $Na_2O$ of approximately 3:1. This provides the necessary amount of $SiO_2$ for the agglomeration of the detergent and to act as a scouring agent during the washing. The necessary amount of $Na_2O$ is provided for causticity of the washing liquid in emulsifying greases and fat in the manner as is well known in the art. However due to the supply conditions, silicates in aqueous form can not be readily obtainable at this ratio. It has been found however, that the ratio may vary anywhere from approximately 2.4:1 up to 3.25:1 and by appropriate selection of silicate ratios the average ratio of 3:1 can be arrived at. A supplier for the soluble silicates is Philadelphia Quartz Company of Pennsylvania. Other acceptable sources of silicates are the potassium silicates and aqueous solutions thereof having ratios of 2.5:1 sold under the trade mark KASIL by Philadelphia Quartz Company. According to a preferred aspect of the process, the most suitable form of silicate is the aqueous solution of sodium silicate.

Various types of non-ionic surfactants may be used which have low-foaming characteristics. Surfactants which meet the above criteria and which may be employed are polyoxyalkylene non-ionic detergents, polyoxypropylenepolyoxyethylene condensates, alkyl polyoxypropylenepolyoxyethylene condensates, polyoxyalkylene glycols having a plurality of alternating hydrophobic and hydrophylic polyoxyalkylene chains such as those described in U.S. Pat. No. 3,048,548, butylene oxide capped alcohol ethoxylates, benzyl of polyoxyethylene condensates of alkyl penols and alkyl phenoxy polyoxyethylene ethanols.

A particularly preferred type of surfactant used is that sold under the trade mark "Pluronics" by Wyandotte Chemical Corporation which are a polypropylene oxide polyethylene oxide condensate of average molecular weight 2200 to 2800. The amount of surfactant used in spraying the agglomerate must be sufficient to treat or coat the agglomerate in a manner so that the subsequent spraying of the silicates provides a coating on the agglomerate rather than continuing the agglomeration process in forming larger aggregates. A more preferable range of non-ionic surfactant used may be 2 to 5% by weight and in the instance of using "Pluronics" may be approximately 3% by weight. It is also important that the selection of the non-ionic surfactant used, be compatible with the source of chlorine and in particular the chlorinated trisodium phosphate as would be appreciated by those skilled in the art.

The process of this invention eliminates the need for separate drying techniques due to ventilation of the vessel and the volume ratio between the dry constituents and the air in the vessel. However, it should be noted that for a ratio greater than 1:25 there is a physical limitation on the size of the mixer available for use in formulation of large batches. With smaller batches employing a known mixing vessel with a ratio much more than 1:25, the ability to spray the liquid component is greatly impaired. Insufficient powder surface is presented to the spray of the liquid for uniform coating with the result that the wall of the drum is coated. On the other hand for a ratio much less than about 1:8, a greater number of large moist amorphous lumps are produced in view of the greater quantity of dry mixture in the drum. Also, the formulation does not benefit from the aeration needed to avoid additional drying steps.

A preferred embodiment of the process is related to the various views in FIG. 1. Via chute 30, a dry mixture of 30 to 45% by weight of the sodium tripolyphosphate and 20 to 30% by weight of chlorinated trisodium phosphate are charged into the vessel. The selection of the batch size must be such that the ratio of the volume of the dry mixture and the volume of the vessel is between 1:25 and 1:8. After a short time of mixing a small amount of water at ambient temperature is introducted or sprayed onto the dry mixture. The amount of water may be in the range of approximately 1% by weight. Following the water spray, there is the first spray of an aqueous solution at ambient temperature of a sodium silicate having a $SiO_2/Na_2O$ ratio of 2.4:1. The spray pattern is such to distribute the silicate onto the particles in the upper part of the moving bed of the mixture.

After the spary of the first silicate, an aqueous solution at ambient temperature of sodium silicate having a ratio of $SiO_2$ to $Na_2O$ of 3.25:1 is sprayed onto the moving bed of dry material. In order to achieve a ratio of approximately 3:1 for the $SiO_2/Na_2O$, approximately half by solids weight of the total amount of silicate sprayed is of the higher ratio of 3.25:1. The combination of the amounts of silicate sprayed that is between 15 to 30% by weight, is sufficient to complete the agglomeration of the mixture in the vessel.

Referring to FIG. 2, the moving bed 22 of material moves along the bottom of the bed in the direction of the arrow 32 due to drum rotation direction 34. The flight bars 14 carry the material upwardly until it falls back down and moves across the top in the counter current direction of arrow 36. The spray pattern 20 is such to coat the particles moving generally in the direction of arrow 36. Due to the constant churning of the mixture, the spraying is such to contact most of the particles with the silicate to complete agglomeration.

After spraying of the silicates, approximately 1.5 to 6% of the non-ionic surfactant, namely, "Pluronics" is sprayed onto the moving bed of mixture. The "Pluronics" are sprayed at ambient temperature. The quantity of material sprayed is sufficient to coat the surfaces of the agglomerate in preparation for the final spray of silicate.

The final spray of aqueous solution of silicate at ambient temperature may be sodium silicate having an $SiO_2/Na_2O$ ratio of 3.25:1. The percentage by weight sprayed may be 10 to 25% to achieve a total amount of silicate used in the range of 25 to 40% by weight. A preferred percentage of amounts of the first and final spray of silicate is 75% and 25% by weight of the total amount used. The final spray on the treated agglomerate of silicate coats the particle rather than forming further or larger agglomerates to essentially encapsulate the agglomerates with a silicate coating. In order to clean out the nozzels of the system, water is dispensed therethrough. A minimum amount of water is used, roughly less than 1% by weight so as to not upset the coating of the agglomerate by the silicate.

The heat of reaction during the hydration of the sodium tripolyphosphate in heating up the bed 22 is controlled by the combination of vessel ventilation, the volume ratios and the spraying of solutions at ambient temperature. The bed temperature can range from approximately 80° to 110° F. It has been found, however, that at these temperatures the chlorinated trisodium phosphate is relatively stable so that very little chlorine is driven off prior to the encapsulation thereof by the silicate coating. The maximum amount of available chlorine is therefore retained in the product for packaging.

After final clean out of the spray nozzles, the bed of material 22 is discharged where for a short period the material may be mixed before discharge. During discharge the material is constantly exposed to the ventilated air of the drum. The volume ratio is such to ensure that any further heat generated by the heat of reaction of hydration is taken away from the bed area so that its temperature remains in the area of 80° to 110° F.

Referring to FIG. 1, the product is discharged into a screen device 38 where product falling through number 10 mesh United States Standard Screens is transferred to a further screening stage. Any particles which are greater than 10 mesh are discharged at 40, ground in a Stokes granulator and transfered to the further screening stage. At the further screening stage fines pressing a 60 mesh screen are removed and recycled.

The agglomerate of the desired size between 10 mesh and 60 mesh is transfered to storage and aged for at least 12 hours in fiber drums at room temperature and pressure. After aging the product is packaged as per well known methods in the art.

The following Examples A and B demonstrate preferred embodiments of the process in the manufacture of a dishwashing detergent.

EXAMPLE A 6,000 pounds of agglomerated dishwasher detergent were manufactured according to the process:

| STEPS | | INGREDIENTS ADDED AT EACH STEP | AMOUNT (lbs) | STEPS PERFORMED ÷ELAPSED TIME (Nearest Minute) |
|---|---|---|---|---|
| I | | Anhydrous Sodium Tri-polyphosphate | 2544 | 0 |
| | | Chlorinated Trisodium Phosphate | 1272 | 15 |
| | | Ratio of Volume of Dry Constituents/ Volume of Air in Mixing Vessel 1:18 | | |
| | | Mixed | | 24 |
| II | (a) | Water | 43 | 27 |
| | (b) | Sodium Silicate $SiO_2/Na_2O$ 2.4:1 (53% $H_2O$) | 735 | 28 |
| | | Sodium Silicate $SiO_2/Na_2O$ 3.25:1 (63% $H_2O$) | 600 | 52 |
| | (c) | Pluronics - L62D | 120) | 68 |
| | | (Together)- L61 | 60) | |
| | (d) | Sodium Silicate $SiO_2/Na_2O$ 3.25:1 (63% $H_2O$) | 540 | 78 |
| | (e) | Water | 86 | 93 |
| III | | Ventilation of Agglomerate | | 95 |
| IV | | Discharged | | 155 |
| V | | Aged: About 24 hours. | | |

EXAMPLE B 12,000 pounds of agglomerated dishwasher detergent were manufactured according to the process.

| STEPS | | INGREDIENTS ADDED AT EACH STEP | AMOUNT (lbs.) | STEPS PERFORMED: ELAPSED TIME (Nearest Minute) |
|---|---|---|---|---|
| I | | Anhydrous Sodium Tri-polyphosphate | 5088 | 0 |
| | | Chlorinated Trisodium Phosphate | 2544 | 30 |
| | | Ratio of Volume of Dry Constituents: Volume of Air in Mixing Vessel-1:8 | 48 | |
| II | (a) | Water | 74 | 53 |
| | (b) | Sodium Silicate $SiO_2/Na_2O$ 2.4:1 (53% $H_2O$) | 1470 | 55 |
| | | Sodium Silicate $SiO_2/Na_2O$ 3.25:1 (63% $H_2O$) | 1200 | 103 |
| | (c) | Pluronics L62D | 240 | 136 |
| | | L61 | 120 | |
| | (d) | Sodium Silicate $SiO_2/Na_2O$ 3.25:1 (63% $H_2O$) | 1080 | 156 |

-continued

| STEPS | INGREDIENTS ADDED AT EACH STEP | AMOUNT (lbs.) | STEPS PERFORMED: ELAPSED TIME (Nearest Minute) |
|---|---|---|---|
| (e) | Water | 184 | 185 |
| III | Ventilation of Agglomerate | | 190 |
| IV | Discharged | | 310 |
| V | Aged: About 24 hours | | |

The product prepared in Examples A and B was free-flowing and granular demonstrating that suitable product is obtainable at volume ratios of 1:8 and 1:18.

The characteristics of the product where evaluated by obtaining samples after step III of Examples A & B. The so obtained samples were tested with the following results.

| | FORMULATION | |
|---|---|---|
| | EXAMPLE A | EXAMPLE B |
| Available Chlorine | 0.69% | 0.61% |
| Total Actives | 2.80% | 2.81% |
| Moisture Content | 26.4% | 22.8% |
| Bulk Density | 0.92 gm/cc | 0.87 gm/cc |
| pH of 1% solution | 10.8 | 10.85 |
| Screen Analysis on 10 mesh screens | 1.4% | 0.3% |
| through 60 mesh Screens | 11.9 | 10.3% |

The results of the above test and following tests are not uniform because the agglomeration process results in a non-uniform distribution of the ingredients in the agglomerate. Samples of the aged agglomerate as packaged and stored for 24 hours were tested to reveal the following moisture and chlorine contents.

| PACKAGED MATERIAL FROM SAMPLE | | |
|---|---|---|
| BOX | MOISTURE (%) | CHLORINE (%) |
| 1 | 26.3 | .71 |
| 2 | 26.0 | .71 |
| 3 | 26.1 | .73 |
| 4 | 24.4 | .67 |

The above test results demonstrate that the chlorine content is at a relatively high level for the aged product. To demonstrate the extended shelf life of the product's chlorine retension, the following in house prepared product sample numbers 1 to 4 and commercial product sample numbers 5 to 7 were assayed to give the following results:

| SAMPLE NO. | ORIGINAL AVAILABLE CHLORINE | SHELF LIFE | REMAINING AVAILABLE CHLORINE |
|---|---|---|---|
| 1 | about .70% | 23 months | .48% |
| 2 | about .70% | 23 months | .48% |
| 3 | about .70% | 23 months | .40% |
| 4 | about .70% | 23 months | .44% |
| 5 | .70% | 11 months | .54% |
| 6 | .70% | 7 months | .64% |
| 7 | .73% | 5 months | .58% |

The above assay results clearly demonstrate that even over a 23 month period the stability of available chlorine in the product of approximately 0.4% is far superior to any known packaged dishwasher detergent. This is due to the aspect of the invention in carrying out the process at lowered bed temperatures in a ventilated mixing vessel and encapsulating or coating the formed agglomerate to inhibit chlorine loss as demonstrated by these test results.

Six months is an accepted period shelf life. It can be seen from the 7 month test that the chlorine loss is approximately 8 to 9%. This is far superior to known chlorine losses of 20 to 30% of other packaged product over a span of 6 months, such as, demonstrated in Sumner, U.S. Pat. No. 3,625,902.

Packaged products of Example A were tested to determine the extent of hydration of the sodium tripolyphosphate. The determination was made by X-ray defraction measurements where the packaged products were compared to a control sample containing 30% sodium tripolyphosphate, 50% sodium tripolyphosphate hexahydrate and 20% chlorinated trisodium phosphate. The results of these X-ray defraction measurements are set out below:

| BOX | % HEXAHYDRATE OF FINAL AGGLOMERATE |
|---|---|
| 1 | 48.5 |
| 2 | 56.0 |
| 3 | 56.0 |
| 4 | 53.0 |

These results establish that there is substantial hydration of the original anhydrous sodium tripolyphosphate. The percentage hydration can go as high as 76.

The product was free flowing and was tested on several different occasions in dishwashers and was found to provide a desireable cleaning action on the dishes comparable to any known dishwasher detergent without caking or gumming of the product in the dishwasher.

Although various preferred embodiments of the invention have been described herein in detail it will be understood by those skilled in the art that variations may be made thereto without departing from the spirit of the invention or the scope of the appended claims.

The embodiments of an invention in which an exclusive property or privilege is claimed and defined as follows:

1. A process for manufacturing in a single mixing vessel a free-flowing granular dishwasher detergent of typical components including hydrated forms of sodium tripolyphosphate, a silicate selected from the group consisting of sodium silicate, potassium silicate and mixtures thereof having a weight ratio of $SiO_2$ to $Na_2O$ or $K_2O$ between approximately 2.4:1 and approximately 3.25:1, chlorinated trisodium phosphates, a non-ionic surfactant and their chemical equivalents; said process comprising the steps of:

(i) mixing in a ventilated mixing vessel, a dry mixture of 30 to 45% by weight of sodium tripolyphosphate and 20 to 30% by weight of chlorinated trisodium phosphate, the ratio of the volume of said dry mixture and the volume of said vessel being between about 1:25 to 1:8;

(ii) spraying approximately 15 to 30% by weight of an aqueous solution of selected silicate at ambient temperature onto said dry mixture while continuing the mixing to form an agglomerate of the dry mixture during hydration of said sodium tripolyphosphate;

(iii) spraying onto the formed agglomerate, 1.5 to 6% by weight of the non-ionic surfactant at ambient temperature while continuing the mixing of the formed agglomerate;

(iv) coating the treated agglomerate while continuing its mixing by spraying onto it, a further 10 to 25% by weight of an aqueous solution of selected silicate at ambient temperature to make up a total of 25 to 40% by weight of silicate used;

(v) mixing the coated agglomerate in the vessel to ventilate it to the air of the vessel while discharging the coated agglomerate from such vessel;

said ratio of volumes and the ventillation of such mixing vessel maintaining the mixture temperature in a range at which said chlorinated trisodium phosphate is relatively stable to retain available chlorine in the formed agglomerate, the silicate coating of the formed agglomerate inhibiting chlorine loss from the dishwasher detergent over extended periods of shelf-life.

2. A process of claim 1 wherein said selected silicate is sodium silicate.

3. A process of claim 1 wherein from 2% to 5% by weight of non-ionic surfactant is used.

4. A process of claim 2 wherein 3% by weight of said non-ionic surfactant is used.

5. A process of claim 4 wherein said non-ionic surfactant is a polypropylene oxide polyethylene oxide condensate of average molecular weight 2200–2800.

6. A process of claim 1 comprising the further intervening steps of:

(i) (a) after mixing, spraying a minor amount of water, approximately 0.5 to 1.0% by weight, to commence hydration of said sodium tripolyphosphate; and (iv) (a) after coating, spraying a minor amount of water, approximately 1.0 to 2.0% by weight, to flush out the spraying system used to spray said silicates.

7. A process of claim 1 wherein said volume ratio is from 1:18 to 1:8.

8. A process of claim 1 wherein said mixing vessel is a drum rotatable about its horizontal axis, said drum having a plurality of flight bars to effect mixing on its being rotated, at least one end of said drum having an opening to provide drum ventillation, the mixing resulting in a moving bed of material on the bottom of said drum where the spraying is directed downwardly onto the moving bed.

9. A free-flowing granular dishwasher detergent composition comprising silicate coated agglomerates, when prepared according to the process of claim 1.

10. A free-flowing granular dishwasher detergent composition comprising silicate coated agglomerate when prepared according to the process of claim 2.

* * * * *